US006100847A

United States Patent [19]

Sointula

[11] Patent Number: 6,100,847

[45] **Date of Patent: *Aug. 8, 2000**

[54] ANTENNA WITH A TRANSMIT FREQUENCY BAND PASS FILTER COUPLED TO A RADIATIVE ELEMENT

[75] Inventor: Erkka Sointula, Marynummi, Finland

[73] Assignee: Nokia Mobile Phones Limited, Salo, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/721,678

[22] Filed: Sep. 27, 1996

[30] Foreign Application Priority Data

Oct. 6, 1995 [GB] United Kingdom ..... 9520475

[51] Int. Cl.[7] ..... H01Q 1/24

[52] U.S. Cl. ..... 343/702; 343/725

[58] Field of Search ..... 343/702, 745, 343/749, 729, 850, 852, 853, 725; 155/11.1, 12.1, 575, 90; H01Q 1/24

[56] References Cited

U.S. PATENT DOCUMENTS

| | | | |
|---|---|---|---|
| 4,727,598 | 2/1988 | Ehlers | 343/702 |
| 4,998,078 | 3/1991 | Hulkko | 333/109 |
| 5,072,232 | 12/1991 | Korner | 343/729 |
| 5,276,920 | 1/1994 | Kuisma | 455/101 |
| 5,341,149 | 8/1994 | Valimaa et al. | 343/895 |
| 5,451,967 | 9/1995 | Ueda et al. | 343/715 |
| 5,490,284 | 2/1996 | Itoh et al. | 455/11.1 |
| 5,581,268 | 12/1996 | Hirshfield | 343/895 |
| 5,614,875 | 3/1997 | Jang et al. | 333/202 |
| 5,628,049 | 5/1997 | Suemitsu | 455/11.1 |

FOREIGN PATENT DOCUMENTS

| | | | |
|---|---|---|---|
| 0 386 255 A1 | 9/1990 | European Pat. Off. . | |
| 470797A3 | 2/1992 | European Pat. Off. | H01Q 1/24 |
| 0 637 093 A1 | 2/1995 | European Pat. Off. . | |
| 24 61 994 A1 | 11/1975 | Germany . | |
| 5-308213 | 11/1993 | Japan | H01Q 1/24 |
| 587627 | 5/1947 | United Kingdom . | |
| 2 207 557 | 2/1989 | United Kingdom . | |
| 2 242 573 | 10/1991 | United Kingdom . | |

*Primary Examiner*—Hoanganh Le
*Attorney, Agent, or Firm*—Perman & Green, LLP

[57] ABSTRACT

An antenna module suitable for use with a radio telephone is disclosed. The antenna module 200 comprises an antenna 132, suitably multifilar configuration, and a support 118 which supports the antenna. The support also supports a filter 128, 124 which is electrically coupled to the antenna, and an amplifier 124 electrically coupled to the filter. The amplifier is non-fixedly coupled to radio circuitry housed within a radio housing 102. Typically, the antenna module can be non-fixedly coupled to the radio housing.

11 Claims, 2 Drawing Sheets

ANTENNA WITH A TRANSMIT FREQUENCY BAND PASS FILTER COUPLED TO A RADIATIVE ELEMENT

FIELD OF THE INVENTION

This invention relates to an antenna module for a radio which may be applied, for example, to a portable radio and particularly, but not exclusively, to a hand portable radio telephone suitable for satellite radio telephone systems.

BACKGROUND OF THE INVENTION

A radio intended for two-way communication generally operates with either an external fixed rod or retractable antenna, or with an internal antenna. The fixed rod type of antenna has a predetermined length. Whilst such antenna as can be relatively short, they are not conducive to a compact design nor are they particularly suitable for a radio intended to be carried in a pocket or other receptacle offering restricted space. On the other hand, retractable antennas are convenient for this purpose because they can be folded away when the radio is not in use. Retractable antennas are commonly of the telescopic tube type, although retractable fixed length antennas are also known.

Generally, there has been a trend to using more compact antennas such as internal antennas or retractable antennas. This is due to users of radios desiring the radios to be as compact as possible. Retractable or foldable antennae are mechanically coupled to the radio housing by a moveable joint, for example a rotating joint or a make or break connector comprising complementary colletts as described in British Patent Application 2 257 836. A problem with such moveable joints is that they do not provide good radio frequency coupling to radio circuitry disposed in the housing and are a source of high losses, especially at microwave frequencies.

This is a particular problem in applications where the received radio signal is of a very low power level, for example satellite receivers. In a GPS satellite receiver a Low Noise Amplifier (LNA) has been included in the antenna housing before the coupling to the radio housing. An example of such an antenna and LNA is a dielectric patch antenna package manufactured by FDK Corporation Model No. DA-IC05.

It is noted that the term "elongate antenna element" as used herein encompasses for example a rod type antenna or a coil type antenna a having a generally elongate configuration. Also the term "helical" is not restricted to a helix having a uniform diameter but is intended to include a coil having a progressively widening diameter, viz. a spiral configuration, and multi-filar configurations.

SUMMARY OF THE INVENTION

According to the present invention there is provided an antenna module for a radio, comprising a radiative element, a filter means electrically coupled to the radiative element and disposed proximal to the radiative element, an d an amplifying means electrically coupled t o the filter means, wherein the module further comprises coupling means for non-fixedly coupling the amplifying means to a radio.

This has an advantage in that the radiative element and filter can be coupled together directly, or via just an impedance matching or phase shifting network. Thus, transmission of a signal from the radiative element to the front end fiter via lossy elements such as co-axial cable or non-fixed couplings for example, is unnecessary, and losses or noise introduced by such transmission can be avoided. Additionally, relatively large components such as filters may be placed in the antenna module and thus outside of a radio housing, thereby reducing the volume required for the radio housing and facilitating smaller sized radios. Such is especially the case when the antenna module is detachable for example in dual mode or dual band GSMiSatellite radio telephones. A further advantage is that the front end filtering and amplification can take place within the antenna support rod. Thus, low power received signals do not need to be coupled across moveable generally lossy joints before amplification, but can be amplified before being coupled across such joints. This improves the signal to noise ratio of the signals coupled across the joint.

Preferably the coupling means is adapted to non-fixedly couple the antenna assembly to a radio housing, which results in the antenna module being capable of forming a part of the radio only when it is in use, making its use convenient for a user.

Optionally, for transmit signals amplification can take place after the moveable joint which reduces the absolute power lost when coupling over a moveable joint compared to amplifying the signal prior to the moveable joint. This is more efficient and for portable radio devices will act to prolong battery life.

Generally, the filter means is a receive frequency band pass filter. Thus, the typically low power received signal can be input to the receive frequency band pass filter with as little attenuation or increase in noise as possible.

Advantageously, the amplifying means is a Low Noise A mplifier (LNA). By disposing an LNA after the receive filter there is the advantage that the LNA is not subject to spurious signals outside the receive band. This is particularly useful for satellite phones where the LNA is optimised for the relatively very low power signals received from the satellite system compared to signals from terrestrial sources at frequencies outside the receive band. Such filtering of the spurious signals inhibits noise interference or generation in the LNA and desensitisation of the LNA.

A transmit frequency band pass filter may be disposed within the antenna module and electrically coupled to the radiative element. Optionally, a transmit frequercy band pass filter is disposed within the antenna module and electrically coupled to a further radiative element adapted to be operable for a transmit frequency band. A power amplifier may be coupled to an input of the transmit frequency band pass filter. Thus, much of the front end of a radio frequency part of a radio can be conveniently located in the antenna module.

In an embodiment in accordance with the invention having both receive and transmit circuitry, duplexors or switches may be employed to switch between receive and transmit signals. This increases the complexity of the circuitry and results in greater power losses. However the use of an LNA acts to compensate for this power loss.

The filter means, receive and/or the transmit frequency band pass filter may comprise longitudinally coupled co-axial resonators and/or half wavelength ceramic resonators, which may have a circular cross-section making them particularly suitable for incorporation into an antenna support which is typically cylindrical.

In a particularly advantageous embodiment there is further provided a support means for supporting the radiative element, wherein the filter and amplifying means are disposed within the support means. The disposition of the filter and amplifier advantageously utilise the fact that radiative elements are preferably disposed away from a user when in use, that is to say at the top of a support rod, and use space in the support rod which would otherwise be unused. Advantageously the antenna module is removably connectable to a housing for a radio. Thus, the relatively expensive and heavy components of the antenna module need only be coupled to the radio as required. This is particularly advantageous in a dual mode telephone such as a GSMwSatell telephone where use as a satellite telephone is likely to be infrequent. The antenna module can be designed for satellite use and utilised only when a satellite call is desired to be made. Thus, the relatively bulky and heavy antenna module need not be carried at all times.

DETAILED DESCRIPTION OF THE EMBODIMENTS OF THE INVENTION

Embodiments in accordance with the invention will now be described, by way of example only, and with reference to the accompanying drawings.

Figure 1:
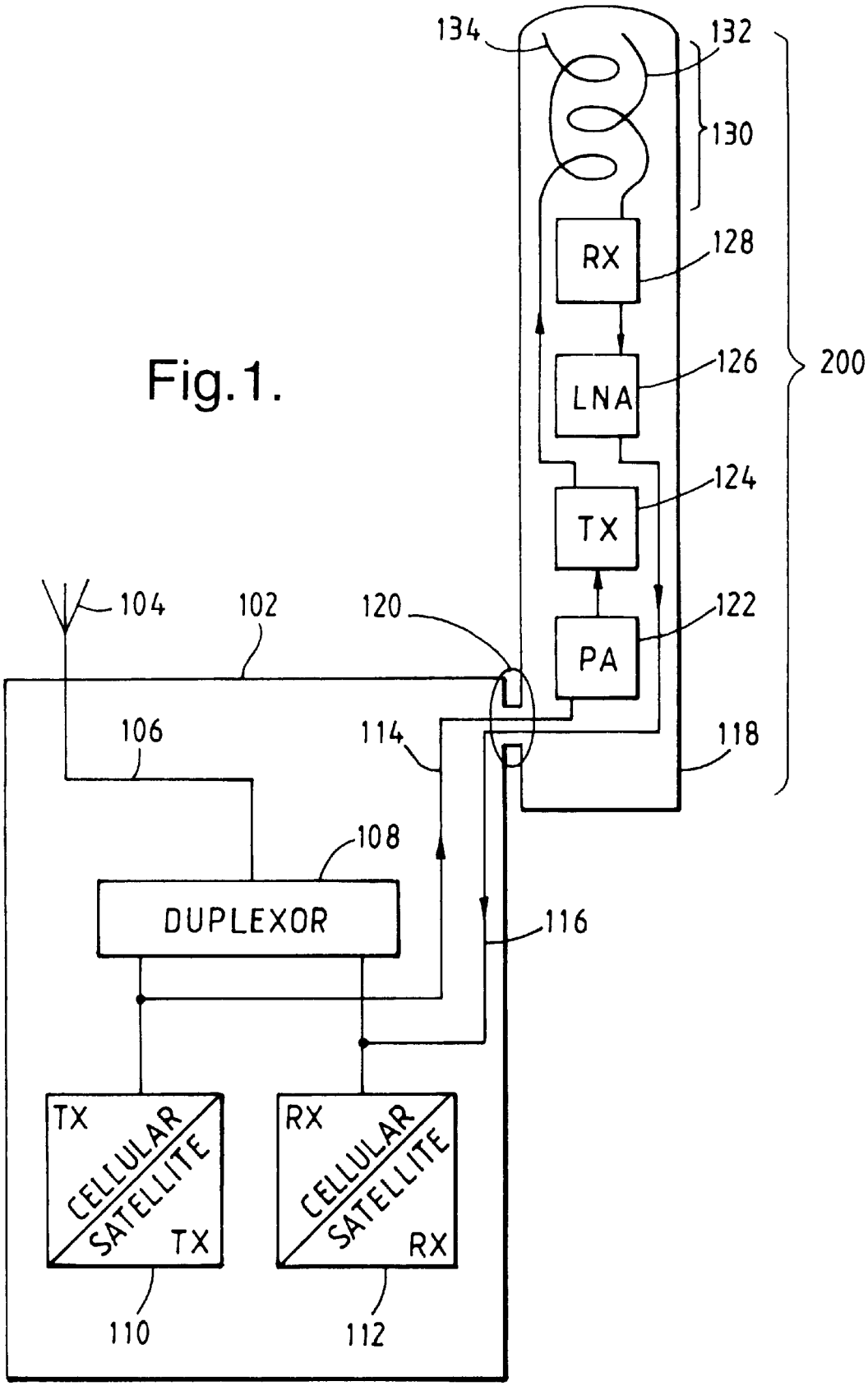
FIG. 1 is a schematic cross-section of a portable radio telephone incorporating an antenna module in accordance with the present invention.

The portable radio telephone shown in FIG. 1 comprises a housing 102 enclosing a conventional transmitter 110 and receiver 112 coupled respectively via a duplexor 108 to the inner conductor of the co-axial feed 106 to a conventional antenna 104. An example of such a conventional antenna 104 is further described in British Patent Application 2 257 836.

The housing 102 also encloses all the other features conventionally found in a portable radio telephone. Since these aspects are not directly relevant to the instant invention no further details will be given here.

The portable radio telephone further comprises an antenna module 200 in accordance with an embodiment of the present invention. The antenna module 200 comprises a support 118 enclosing various components. At one end of the support there is disposed an antenna 130 coupled to a receive filter 128 which in turn is coupled to a low-noise amplifier 126. The antenna 130 is also coupled to a transmitter filter 124 which in turn is coupled to a power amplifier 122. Antenna 130 may option ally comprise two elements, a receive antenna and transmit antenna respectively coupled to the receive filter 128 and transmit filter 124. The antenna module 200 is mechanically coupled to the housing 102 at region 120 (circled). The mechanical coupling of the antenna assembly 200 to the housing 102 may be by means of a rotatable joint or a sliding connection such that the antenna module 200 may be folded away or retracted into the housing 102 when not in use. Optionally, the antenna module 200 may be coupled to the housing 102 by means of a screw or snap-fit coupling such that when the antenna module 200 is not required for use, it may be stored away from the housing 102 such as in a user's pocket or briefcase. This obviates the need for the housing 102 to have sufficient space to accommodate the antenna module 200 which results in the housing 102 being capable of being of smaller volume than might otherwise be necessary. Additionally, the extra weight of the antenna module 200 is removed from the housing 102 thereby resulting in a radio telephone which is generally relatively light and only has increased weight when it is necessary to utilise the antenna module 200.

Signals from the receive filter 128 via the low-noise amplifier 126 may be coupled into the conventional receiver 112 via a suitable transmission means 1161 such as a co-axial connection, for signal processing and the like. The transmit filter 124 may be coupled via the power amplifier 122 to a transmission means 114 which in turn is coupled to conventional transmitter 110. Signals from the transmitter 110 may then be directed to the power amplifier 122 and through the transmit filter 124 to be radiated by transmit antenna 132.

In a particular embodiment of the invention the portable radio telephone is a dual mode telephone operable for both the Global System for Mobiles (GSM) radio telephone network, and a satellite radio telephone network such as the proposed INMARSAT system, Since the frequency of operation of the proposed INMARSAT satellite system is different to the frequency of operation of the GSM system it is necessary to have two separate antenna systems i.e. the conventional antenna 104 and the antenna module 200. Advantageously, the transmitter 110 and receiver 112 could comprise both the circuitry for implementing GSM processing and for processing signals for use with the INMARSAT system. Typically, this would require that respective GSM and INMARSAT signals are switched to different down converting units using different local oscillator frequencies in order to convert the signals to s uitable base-band frequencies. Suitably, any commonality between respective signals would facilitate the dual use of respective transmitter 110 and receiver 112 circuitry. A dual mode DCS 1900/INMARSAT system would be particularly suitable for sharing TX/RX circuitry since the DCS system operates at 1900 MHz and INMARSAT at 200 MHz. Thus, similar local oscillators and circuitry could be used for both systems. However, if this is not possible then separate GSM or DCS and INMARSAT circuitry would need to be included within housing 102.

Such embodiments utilise the present invention to great effect, since it would be usual that a user would typically use the GSM or DCS system more often than the INMARSAT system. Thus a user may advantageously have a low volume light weight portable cellular radio telephone for the majority of time, but when requiring to communicate via a satellite system can couple the satellite antenna module 200 to t he housing 102.

Figure 2:
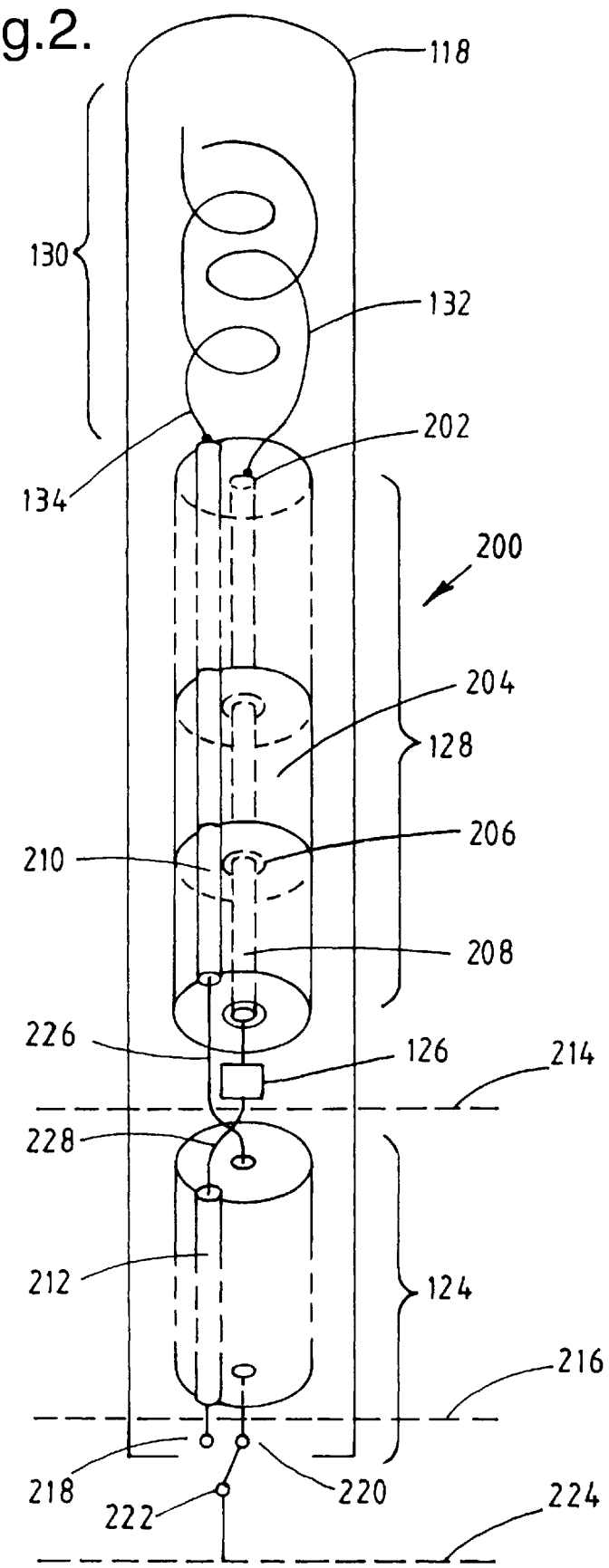
FIG. 2 is an enlarged cross-section showing the antenna module in FIG. 1 in more detail.

An antenna module 200 in accordance with an embodiment of the invention will now be described with reference to FIG. 2 and in the context of being operable for a satellite radio telephone system such as INMARSAT. Similar components already described with reference to FIG. 1 shall be described by the same reference numerals as used in respect of FIG. 1. Support 118 enclosing components of the antenna module may be made of any suitable plastics material capable of supporting the components and supporting a mechanical coupling to the housing 102. In a satellite radio telephone system such as INMARSAT the receive and transmit frequencies are widely separated, for example by 200 MHz, and consequently it is not possible to design a single antenna capable of both receiving and transmitting on such widely separated frequencies. This problem is exacerbated by the fact that the receive signal is generally very low power and the receive antenna is optimised to the receive frequency band in order to satisfactorily receive signals from the satellite system. Therefore, the antenna 130 comprises separate receive antenna 132 and transmit antenna 134. The separate receive and transmit antennas 132, 134 are formed in a multi-filar helical configuration. Optimally, the antenna may be a quadri-filar antenna. The antenna 130 may also comprise other antennae 132, 134 such as rod antennae. The receive antenna, 132 is suitably coupled to the receive band-bass filter 128 via an impedance matching unit 202 and phasing unit in the case of a multi-filar antenna. The receive band-pass filter 128 is placed as close as possible to the receive antenna 132 in order that transmission losses and noise sources may be minimised. For example, if the receive band-pass filter 128 were to be disposed in the housing 102 of the portable radio telephone then there would need to be a substantial length of transmission line such as a co-axial line to couple the receive antenna to the band-pass filter 128. Such a co-axial transmission line would inevitably introduce losses and thereby attenuate the signal and also could be a source of noise thereby degrading the received signal. The output of the receive band-pass filter 128 is coupled to an input of a low-noise amplifier 126 for amplifying the received signal. Placing the low-noise amplifier 126 after the receive band-pass filter 128 means that the low-noise amplifier 126 can be optimised to process the wanted received signals. The receive band-pass filter should be designed such that it introduces as low losses as possible. Otherwise, the low-noise amplifier 126 would be desensitised and its operating point would be forced away from that optimum for the signals received from the satellite telephone system.

The received signal after amplification from the low-noise amplifier 126 is then coupled via a co-axial line 212 to a receive signal terminal 218.

The transmit antenna 134 is coupled via a transmission co-axial line 210 to the transmit band-pass filter 124. Although not shown in FIG. 2 the transmit band-pass filter 124 may be coupled to a power amplifier 122 either disposed within the support 118 or within the housing 102. As can be seen from broken lines 214 and 216 the components which comprise the antenna module 200 may just comprise the antenna 130 the matching unit 202 the receive band-pass filter 128 and the low-noise amplifier 1 26. The transmit band-pass filter 124 and power amplifier 122 may then be disposed within the housing 102. Optionally, the transmit band-pass filter 124 may also be included within support 118 as part of the antenna module 200 or both the transmit band-pass filter 124 and power amplifier 122 can be included within support 118 as part of the overall antenna module as shown in FIG. 1. A D.C. connection for the LNA 126 and/or power amplifier 122 may be via an R.F. coupling to the housing such as a coaxial line 114/116 or dedicated power line.

The receive band-pass filter 128 comprises ceramic resonators arranged in the form of co-axial ceramic blocks 204. The co-axial ceramic blocks 204 are arranged such that inner conductors are of a half wave-length of the centre frequency of the receive band and are disposed end to end with a small gap or coupling elements between respective ends as shown. Ceramic resonators are particularly useful as small loss filters. Particularly, since matching of impedances, e.g. unit 202, between the antenna and filter, and filter and LNA input can be achieved by appropriately dimensioned lengths of co-axial ceramic blocks. The the ceramic resonators may also act as impedance transformers as well as filters. This reduces discontinuities and thereby losses. A groove 210 may be milled into the external surface of the ceramic blocks forming the receive band-pass filter 128 to receive a co-axial line for transmission of the transmit signal.

A co-axial transmission line for the transmit signal may be disposed outside of the band-pass filter and comprise a conventional transmission line. The transmit co-axial line disposed in track 210 in the band-pass filter 128 is coupled via conductor 226 into the centre conductor of the transmit band-pass filter 124. The transmit band-pass filter 124 is formed in substantially the same manner as the receive band-pass filter 128 and may also include a transmission line 212 which couples the received signal from the low-noise amplifier 126 received via conductor 228 to the receive terminal 218. The input to the transmit band-pass filter 124 comprises transmit terminal 220. The outer shield of coaxial resonators forming the band pass filters 124,128 may be extended and have formed on its surface a phase shifting network coupled to respective elements of the receive/transmit antennas 132, 134.

Optionally, a transmit/receive switch 222 or duplexor may be included in the antenna support, i.e. above line 224, such that it is coupled to the power amplifier 122 and LNA 126 on one side, and to the transmitter 110 and receiver 112 on the other side by a single coupling effectively combining transmission lines 114 and 116 into a single bi-directional line. Thereby reducing the number of electrical connections between the housing 102 and antenna assembly 200, which results in more simple fabrication of connectors and operation. Alternatively, the receive terminal 218 and transmit terminal 220 can be respectively coupled into the transmit 110 and receive 112 circuitry as shown in FIG. 1.

An embodiment in accordance with the present invention may suitably comprise a helical antenna, co-axial in-line ceramic resonators, LNA and power amplifier. All the components may be disposed in line and dimensioned so as to be enclosed within a support for the antenna. Thus, the front end of a transceiver may be formed within the antenna support, which facilitates modularity of a dual or multimode transceiver system such as a GSM/Satellite radio telephone.

In view of the foregoing description it will be evident to a person skilled in the art that various modifications may be made within the scope of the present invention. For example, the antenna may be a single broadband antenna operable over both receive and transmit frequency bands. Additionally, the transmit and receive filters may comprise a duplexor.

The support means for the antenna may comprise a rod member at one end of which the antenna is disposed and the other end of which is supported by a housing for the filters 124, 128 and amplifiers 122, 126.

The scope of the present disclosure includes any novel feature or novel combination of features disclosed herein either explicitly or implicitly or any generalisation thereof irrespective of whether or not it relates to the presently claimed invention or mitigates any or all of the problems addressed by the presently claimed invention. The applicant hereby gives notice that new claims may be formulated to such features during prosecution of this application or of any such further application derived therefrom.

What I claim is:

1. A dual mode hand portable radio telephone comprising:

a handset incorporating a first antenna for use with a communication system; and a second antenna for use with a satellite communication system, the second antenna being couplable, in a removable manner, to the handset and comprising a radiative element, a filter electrically coupled to the radiative element and disposed proximal to the radiative element, an amplifier electrically coupled to the filter and a coupler for coupling in a removable manner the amplifier to the handset.

2. A dual-mode radio apparatus according to claim 1, wherein the filter comprises a receive frequency band pass filter.

3. A dual-mode radio apparatus according to claim 2, wherein the amplifier comprises a Low Noise Amplifier (LNA).

4. A dual-mode radio apparatus according to claim 3 wherein the filter comprises a transmit frequency bard pass filter electrically coupled to the radiative element.

5. A dual-mode radio apparatus according to claim 1, wherein the filter comprises a transmit frequency band pass filter electrically coupled to the radiative element.

6. A dual-mode radio apparatus according to claim 5, wherein the transmit frequency band pass filter is electrically coupled to a further radiative element adapted to be operable for a transmit frequency band.

7. A dual-mode radio apparatus according to claim 6, wherein the amplifier comprises a power amplifier electrically coupled to an input of the transmit frequency band pass filter.

8. A dual-mode radio apparatus according to claim 1, wherein the filter comprises a duplexer.

9. A dual-mode radio apparatus according to claim 1, wherein the filter comprises a longitudinally coupled co-axial resonator, and/or a half wavelength ceramic resonator.

10. A dual-mode radio apparatus according to claim 1, further comprising a support for supporting the radiative element, wherein the filter and amplifier are disposed within the support.

11. A dual-mode portable radio communication apparatus comprising:

a handset having a first antenna for use in at least a first mode of operation of said communication apparatus;

a second antenna for use in at least a second satellite mode of operation of said communication apparatus, said second antenna comprising a detachable antenna module, said detachable antenna module comprising a radiative element, a filter electrically coupled to the radiative element and disposed proximal to the radiative element, an amplifier electrically coupled to the filter and a coupler for coupling in a detachable manner the amplifier to said handset;

whereby said telephone may be operated in the first mode with the second antenna module detached and in the second satellite mode with the second antenna module attached.

* * * * *